US005740618A

United States Patent [19]

Minden

[11] Patent Number: 5,740,618

[45] Date of Patent: Apr. 21, 1998

[54] DYNAMIC TOE SHOE BOX LINER FOR A POINTE SHOE

[76] Inventor: Elizabeth Gaynor Minden, 140 West 16th St., Apt. 5W, New York, N.Y. 10011

[21] Appl. No.: 531,245

[22] Filed: Sep. 20, 1995

[51] Int. Cl.[6] ..... A43B 5/12; A43B 19/00

[52] U.S. Cl. ..... 36/8.3; 36/71

[58] Field of Search ..... 36/8.3, 71, 44, 36/55, 93, 95

[56] References Cited

U.S. PATENT DOCUMENTS

| | | | |
|---|---|---|---|
| 1,744,122 | 1/1930 | Kieeling | 36/8.3 |
| 1,819,766 | 8/1931 | Capezio | 36/8.3 |
| 2,261,041 | 10/1941 | Tennant | 36/95 |
| 2,810,214 | 10/1957 | Wolfe | 36/8.3 |
| 4,513,518 | 4/1985 | Jalbert et al. | 36/44 |
| 4,583,303 | 4/1986 | Liacona et al. | 36/95 |
| 4,813,157 | 3/1989 | Boisvert et al. | 36/44 |
| 4,841,648 | 6/1989 | Shaffer et al. | 36/44 X |
| 4,893,418 | 1/1990 | Ogden | 36/44 |
| 4,901,453 | 2/1990 | Gaynor | 36/113 |
| 5,035,069 | 7/1991 | Minden | 36/113 |
| 5,129,165 | 7/1992 | Woodle | 36/8.3 |
| 5,154,682 | 10/1992 | Kellerman | 36/44 |

FOREIGN PATENT DOCUMENTS

| | | | |
|---|---|---|---|
| 1071419 | 8/1954 | France | 36/95 |
| 405233 | 2/1934 | United Kingdom | 36/8.3 |
| 2205480 | 12/1988 | United Kingdom | 36/8.3 |

*Primary Examiner*—B. Dayoan

*Attorney, Agent, or Firm*—St. Onge Steward Johnston & Reens

[57] ABSTRACT

A dance shoe comprises a toe box having a dynamic foam pad located in at least one of the left and right side surfaces of the toe box and, possibly, the top of the toe box. The dynamic foam pad has a fast resilient characteristic such that the foam pad is compressed by a dancer's foot when the foot is in the flat standing position, but the foam pad expands to snugly hold and support the dancer's foot upon narrowing of the dancer's foot when the dancer is en pointe. A toe pocket cushion is also provided.

22 Claims, 6 Drawing Sheets

FIG. 13
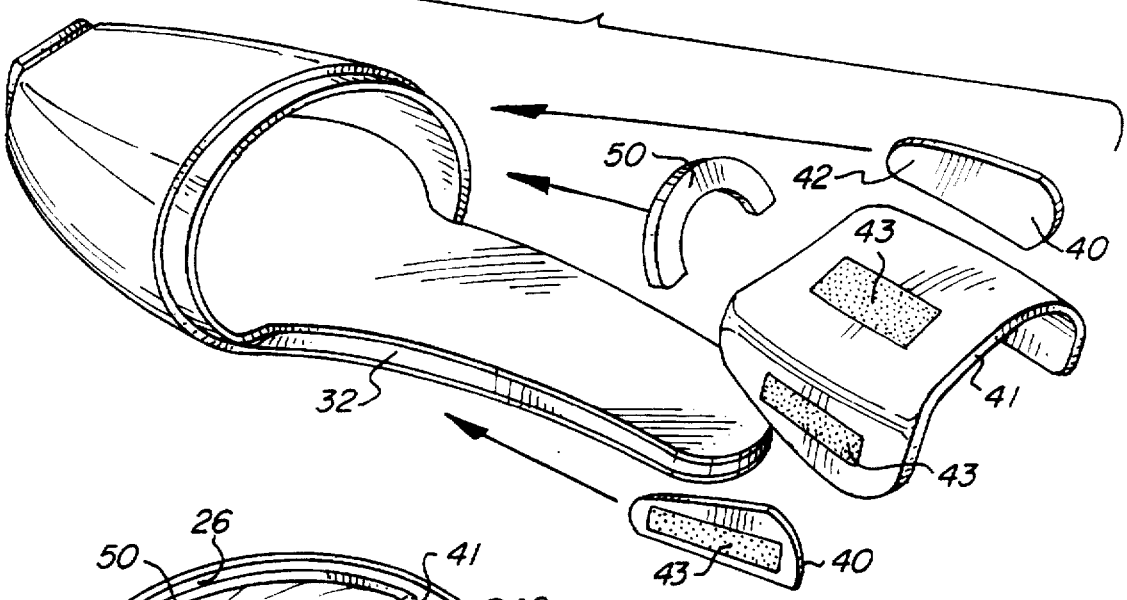
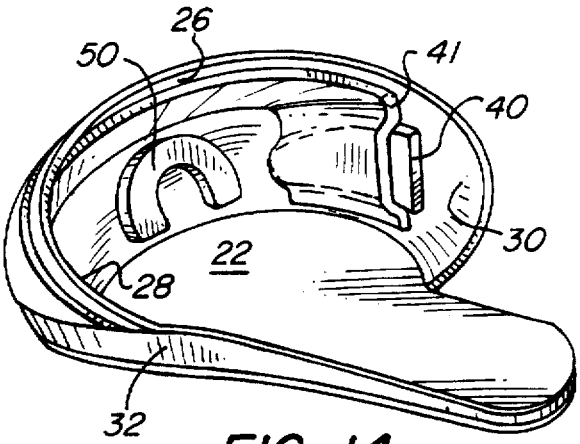
FIG. 14
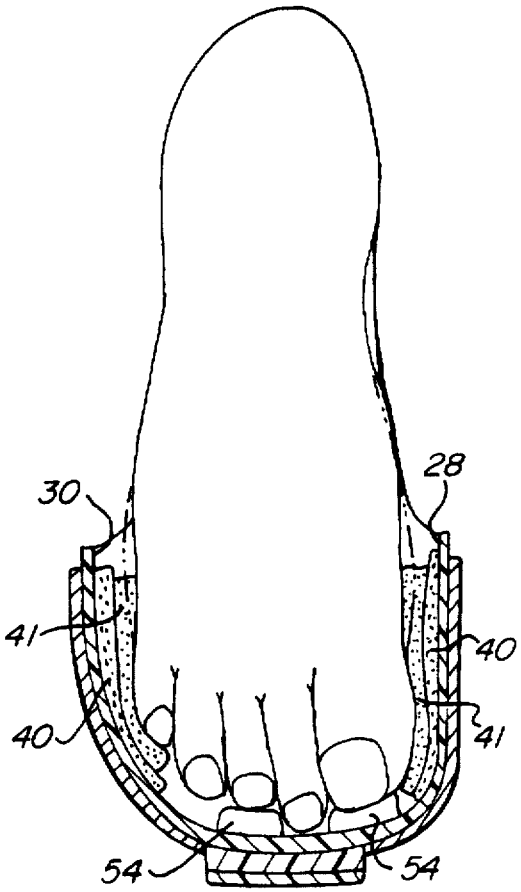
FIG. 12

DYNAMIC TOE SHOE BOX LINER FOR A POINTE SHOE

BACKGROUND OF THE INVENTION

1. Field of the Invention

This invention relates to the field of dance shoes, and particularly, to ballet slippers.

2. Background of the Invention

The demands of the dance choreography, particularly ballet, create significant possibilities of strains and injury to dancers feet. While much of a dancer's training is devoted to exercises that strengthen the ligaments, muscles and tendons of the dancer's feet, there is an ever present discomfort, pain, and risk of injury inherent in the art of dance, especially ballet. These problems are exacerbated when the dancer's shoes do not fit properly. In my prior U.S. Pat. Nos. 5,035,069 and 4,901,453, the disclosures of which are hereby incorporated by reference, I have described the problems associated with traditional blocked ballet slippers, or pointe shoes, made of layers of fabrics, cardboard, paper and/or leather adhered together with glue, such as the extensive breaking in of such shoes by bashing them with a hammer and/or soaking such shoes with water or alcohol. Modern ballet shoes in accordance with the disclosures of the above patents have been designed and have been introduced to the market and dancers have turned in increasing numbers to these modern ballet shoes. These modern ballet slippers have significantly greater durability than traditional pointe shoes. They are immediately usable by the dancer without the need for extensive breaking in. They provide greater comfort while reducing the risk of strains or injuries, and they allow the dancer to dance more quietly.

Ballet dancers' pointe shoes must fit very snugly in order to provide the support required for toe dancing. The stiff toe cup, or "box", that encases the toes must firmly hug the metatarsals to hold the foot in place when the dancer stands on her tip toes, or "en pointe". If the shoe is too wide or too loose the foot will slide unrestrained down into the box, causing all the dancer's weight to be focused on the tips of her longest toes, resulting in pain as well as potentially contributing to problems such as arthritis, bunions, hammer toes, calluses, and bruised or lost toenails.

However, the pointe shoe must also be wide enough at the metatarsal to allow the foot to spread out when landing from jumps and when passing through the position known as "demi-pointe" in transition from normal stance to en pointe. Until now, there has been no means of achieving adequate support en pointe without compromising the width needed for demi-pointe, or of achieving enough width without compromising support. Many dancers choose the overly wide shoe, and attempt to reduce the resulting pain by placing cushioning material under the tips of their toes.

The lack of support in the pointe position is undesirable and can lead to great discomfort and severe pain, and can even increase a risk of strain or injury. Such lack of support for the dancer's foot may also interfere with the dancer's ability to perform, since the dancer may be distracted by problems with the shoe, such as pain, and fear of injury, rather than concentrating on the rigors of the choreography.

SUMMARY OF THE INVENTION

It is an object of the present invention to provide an improved dance shoe that addresses the above problems, and to provide a dance shoe that will snugly fit a dancer's foot whether standing flat footed or en pointe.

In particular, it is an object of the invention to provide a dance shoe with a removable dynamic toe box lining that has a "fast resilience", namely, an ability to be compressed while the dancer is standing flat footed, coupled with an ability to expand quickly to snugly retain and support the dancer's foot when she moves up to the pointe position.

A dance shoe in accordance with the invention comprises a toe box having an inner surface including a top surface and left and right side surfaces, and a shank joined thereto, and a dynamic foam pad located in at least one or both of the left and right side surfaces of the toe box. The removable dynamic foam pad has a fast resilient characteristic such that the foam pad is compressed by a dancer's foot when the foot is in the flat standing position, but the foam pad expands to snugly hold the dancer's foot upon narrowing of the dancer's foot when the dancer's foot is in a pointe position. Dynamic foam pads can be located against both the left side and right side surfaces of the toe box, or, the foam pad may comprise a lining covering the top surface as well as the left and right side surfaces of the toe box.

Preferably, the foam pad is a polyurethane foam such as PORON® foam.

The present invention provides a significant versatility in that the dynamic foam pads are removable. In contrast to fixed prior art shoe liners, the present invention permits continual adjustment by the dancer during the course of the day to accommodate changes in the dancer's foot from swelling, by removing pads, or by adding pads at the beginning of the day.

Other objects, aspects and features of the present invention in addition to those mentioned above will be pointed out in or will be understood from the following detailed description provided in conjunction with the accompanying drawings.

BRIEF DESCRIPTION OF THE DRAWINGS

The present invention may be more clearly understood from the following description of a specific and preferred embodiment read in conjunction with the accompanying schematic and detailed drawings; wherein:

FIG. 12 is the same view as illustrated in FIG. 6, with a toe pocket foam pad additionally installed in the dance shoe.

FIG. 13 is the same view as illustrated in FIG. 7, with a toe pocket foam pad additionally to be installed in the toe box.

FIG. 14 is the same view as illustrated in FIG. 8, with a toe pocket foam pad additionally installed in the toe box.

DETAILED DESCRIPTION OF DRAWINGS

Figure 1:
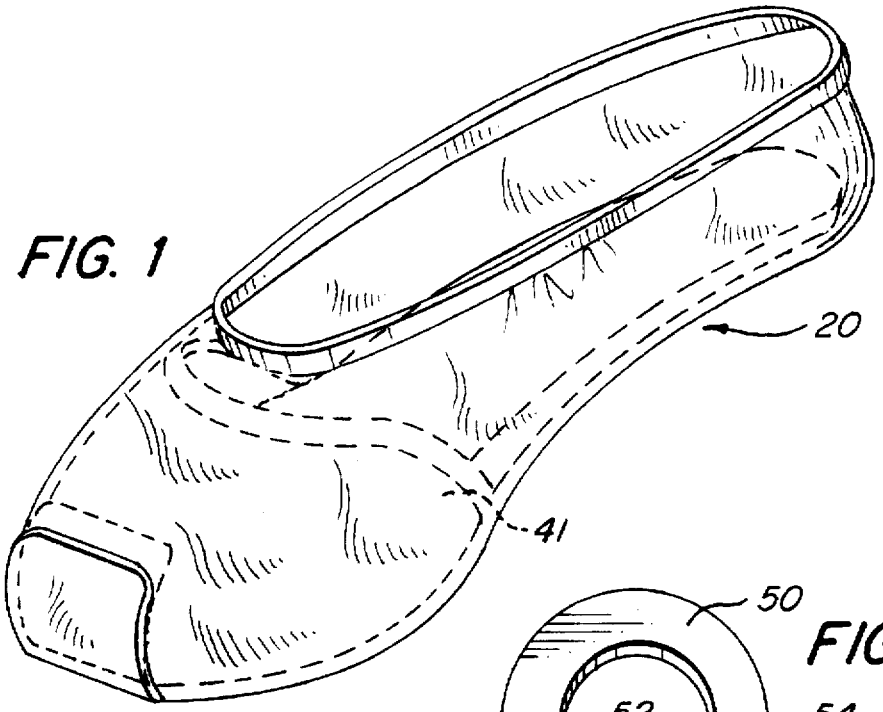
FIG. 1 is a front and side perspective view of an embodiment of a dance shoe in accordance with the invention.
Figure 11:
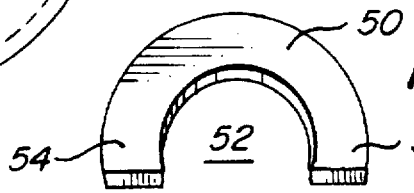
FIG. 11 is a top perspective view of a toe pocket foam pad in accordance with another aspect of the invention.
Figure 9:
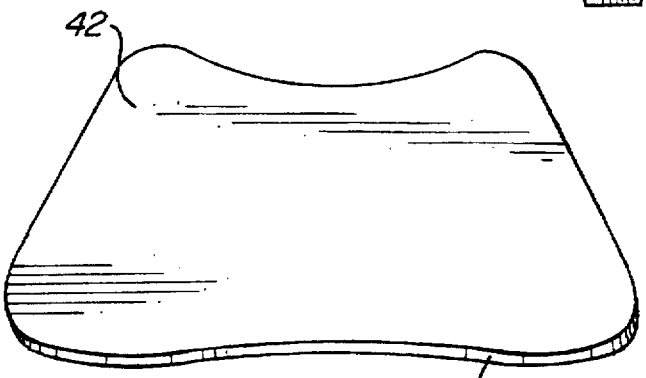
FIG. 9 is a top perspective view of a dynamic foam pad in accordance with the invention in the form of a toe box liner.
Figure 10:
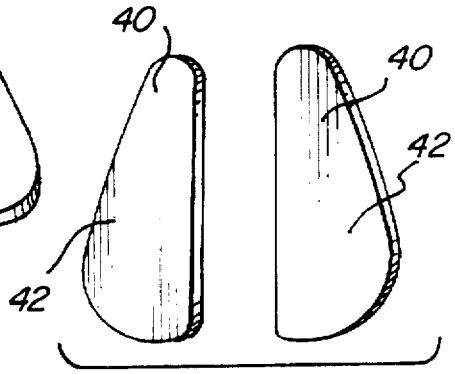
FIG. 10 is a top perspective view of a dynamic foam pad in accordance with the invention in the form of a side cushion.

The present invention is in part based on my recognition that the problems encountered by some dancers is a result of the physiology of particular dancer's feet. In particular, dancers with a "compressible" foot have a tendency in which the foot bones move together when the dancer is en pointe. This problem is exacerbated by the increasing numbers of women who pursue ballet, but whose feet are not suited for prior art pointe shoes. In recent years the ballerina physique that is most prized has become an extremely thin and delicate one. Dancers with this body type usually possess fine-boned feet that exhibit great compressibility at the metatarsal. Because these feet are not at all fleshy, the metatarsals spread apart to a great degree in the normal flat stance, but compress inward to make the foot very narrow when en pointe. These dancers frequently suffer discomfort, strains and injury described above because until now there has been no means of modifying the pointe shoe so that it accommodates the foot in the wide, spread out flat position while still providing support when the foot is in the compressed, en pointe position. The present invention addresses this problem by providing a dance shoe with a removable dynamic toe box lining that has a "fast resilience," namely, an ability to be compressed while the dancer is standing flat footed, coupled with an ability to expand quickly to snugly retain and support the dancer's foot when the dancer is standing en pointe.

The pointe shoe accessories, liners, cushions and inserts of prior art have failed to recognize and address this need. Prior art aims to reduce pain by simply padding the inside of the box, or by molding to the shape of the individual dancer's feet and toes and then retaining that shape. Such liners are said to take a compression set. The liner of the present invention has the exact opposite for its purpose and its function. Liners that retain the shape of the dancer's foot in the flat position are completely useless in providing the tight support needed en pointe. Therefore the dynamic quality, which is completely lacking in the prior art, such as the products sold under the trademark names TOE-FLO, BAL-A-PRO AND TOE CAPS, is essential to the efficacy of the present invention.

Another disadvantage of the liners of prior art is the amount of space they require within the toe box. In order to provide a significant degree of cushioning, such inserts, liners, and cushions must be relatively large because the materials from which they are made are ineffective in thin sections. Ballet aesthetics demand that the pointe shoe have a sleek, delicate appearance. In order to accommodate the large, bulky inserts of prior art, dancers would be required to compromise aesthetics and wear a larger shoe. At the professional level such a compromise is not an option, and professionals suffer greatly from the injuries described above.

A further disadvantage of the liners of prior art is that most of them can only be worn in such a way as to surround and completely encase the forefoot. This results in an extra layer of material underneath the front of the foot and the toes where it interferes with the dancer's ability to feel the floor and to articulate the forefoot, both of which are essential to speed and balance.

The present invention solves the problem of fitting dancers, and especially dancers with compressible metatarsals, by providing a removable toe box lining with dynamic properties. It easily compresses to allow for full expansion of the foot in the normal standing position and in the demi-pointe position, but it instantly springs back to its original thickness when the foot narrows and compresses en pointe. In its original thickness it fills the box in the spaces surrounding the foot so that the foot is snugly supported.

In comparison to these prior art devices, the present invention provides for a more exact fitting of the ballet slipper to the dancer's foot. The foam pads 40,41 of the invention described hereafter are positioned to provide a fit (by selecting from one, two or more of such pads) that is not too tight yet provides the necessary support for the dancer's foot. The invention permits the dancer fine control of the forefoot and provides the necessary comfort and support to dance en pointe with a reduced risk of pain and injury.

Referring now to FIGS. 1–16, a dance shoe 20 in accordance with the invention comprises a toe box 22 having an inner surface 24 including a top surface 26, a left side surface 28, and a right side surface 30. A shank 32 is joined to toe box 22. Preferably shank 32 is integrally formed with toe box 22. A dynamic foam pad such as a side cushion 40 is located in at least one or both of the left and right side surfaces 28, 30 of the toe box 22. In addition, a dynamic foam pad such as box liner 41, covering the top surface as well as the left and right side surfaces of the toe box, may be used in lieu of or in addition to side cushions 40.

Figure 2:
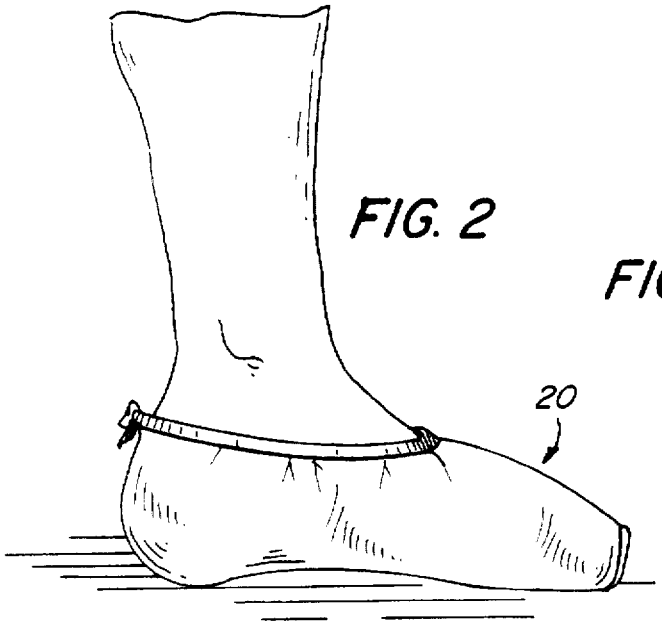
FIG. 2 is a side elevation view of an embodiment of a dance shoe of the present invention as worn by a dancer standing flat footed.
Figure 3:
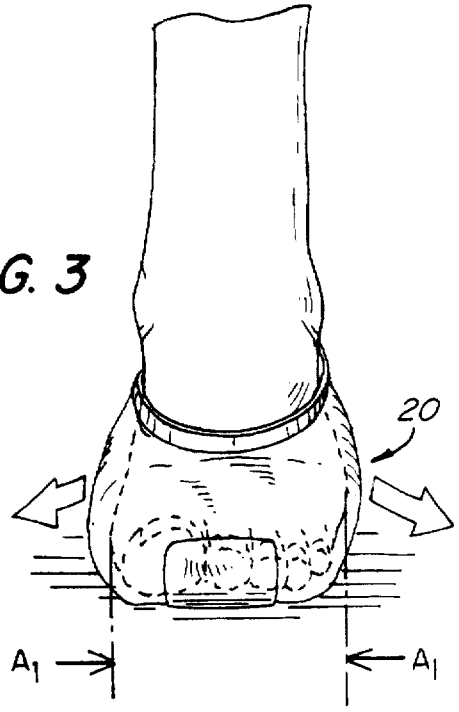
FIG. 3 is a front elevation view the dance shoe of FIG. 2, with the dancer's foot shown in phantom outline.
Figure 4:
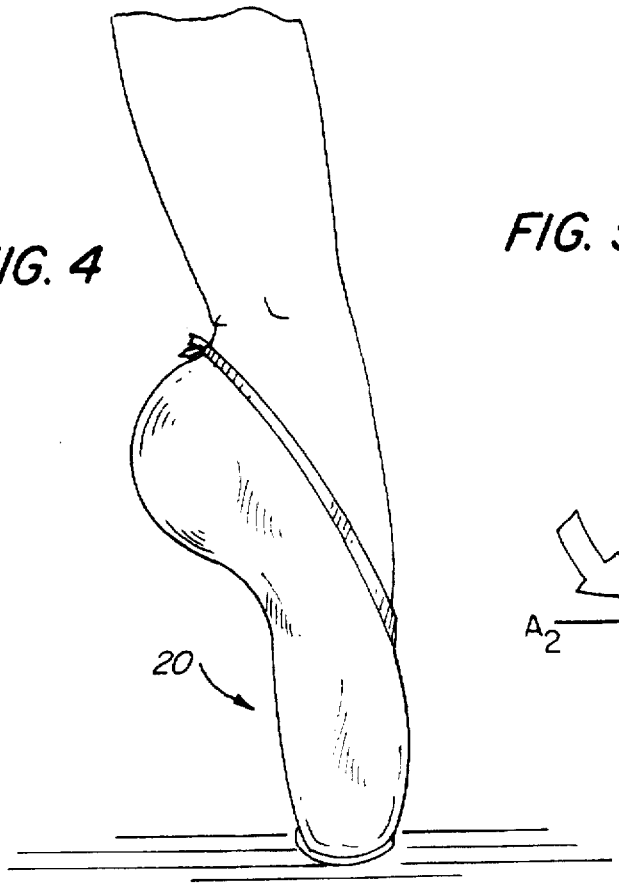
FIG. 4 is a side elevation view the dance shoe of FIG. 2, as worn by a dancer standing en pointe.
Figure 5:
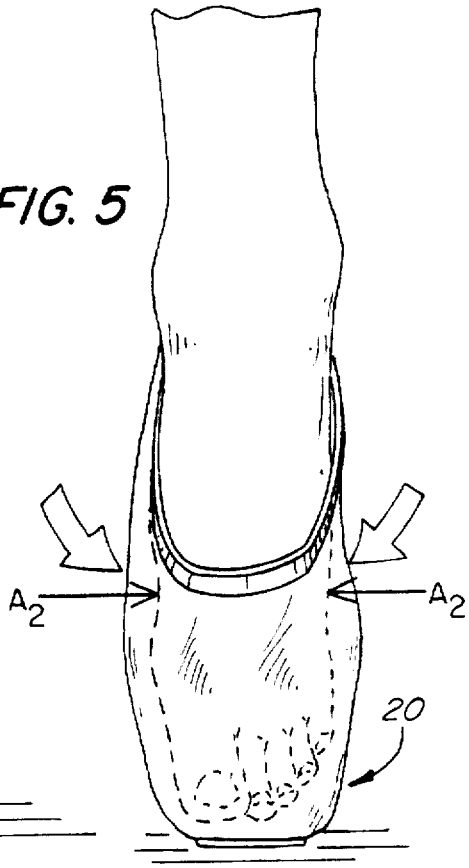
FIG. 5 is a front elevation view the dance shoe of FIG. 4, with the dancer's foot shown in phantom outline.
Figure 7:
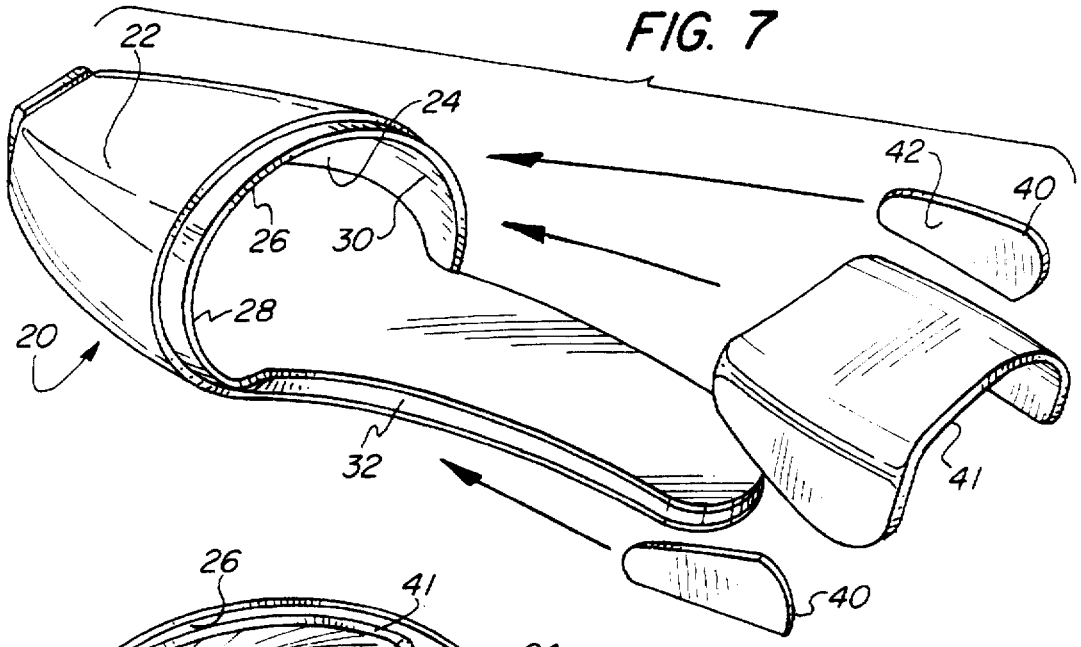
FIG. 7 is a rear perspective view of the toe box and shank of the shoe of FIG. 1 with the outer cover removed, showing the insertion of dynamic foam pads.
Figure 8:
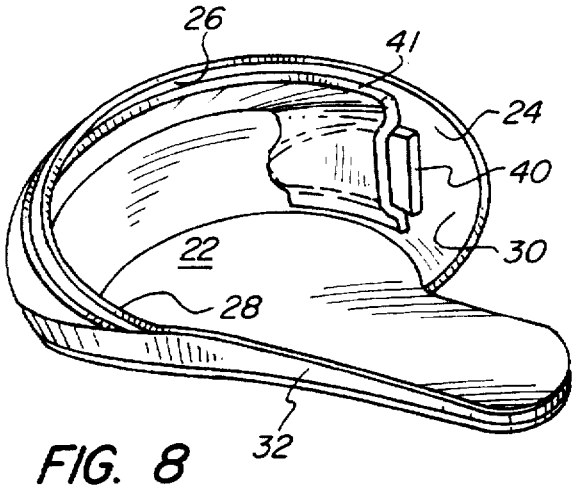
FIG. 8 is a rear perspective view of the toe box and shank of FIG. 7, showing the installed dynamic foam pads.
Figure 6:
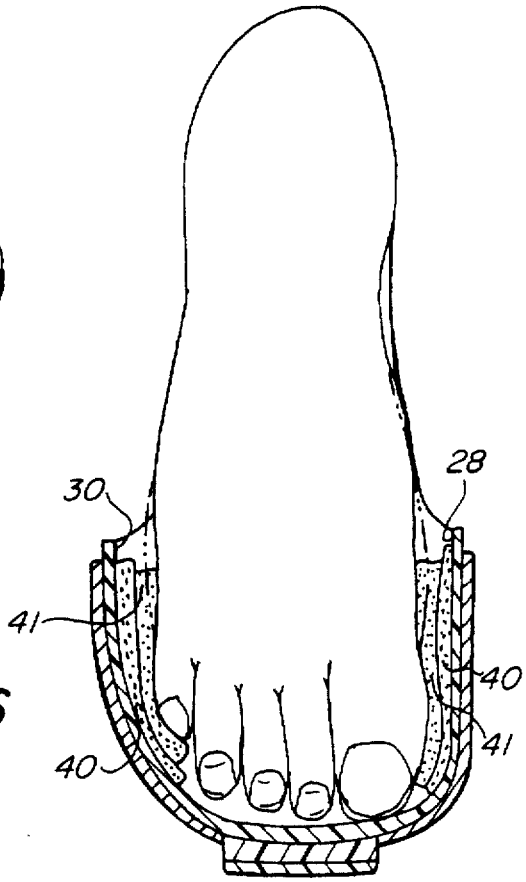
FIG. 6 is a top cross-sectional view of the dance shoe of FIG. 1.
Figure 15:
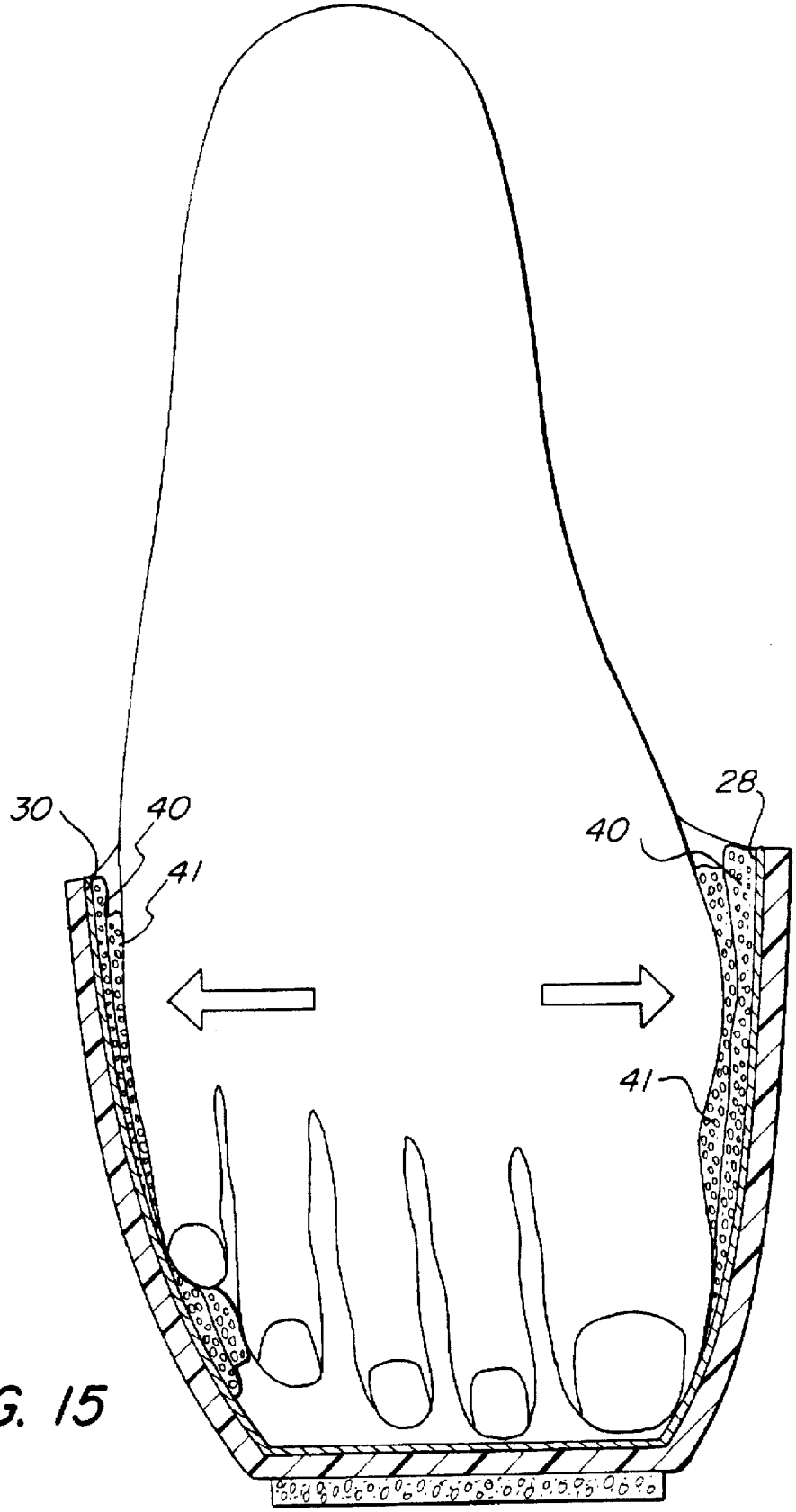
FIG. 15 is a top partial cross-sectional view of the dancer's foot and the dance shoe of FIG. 3.
Figure 16:
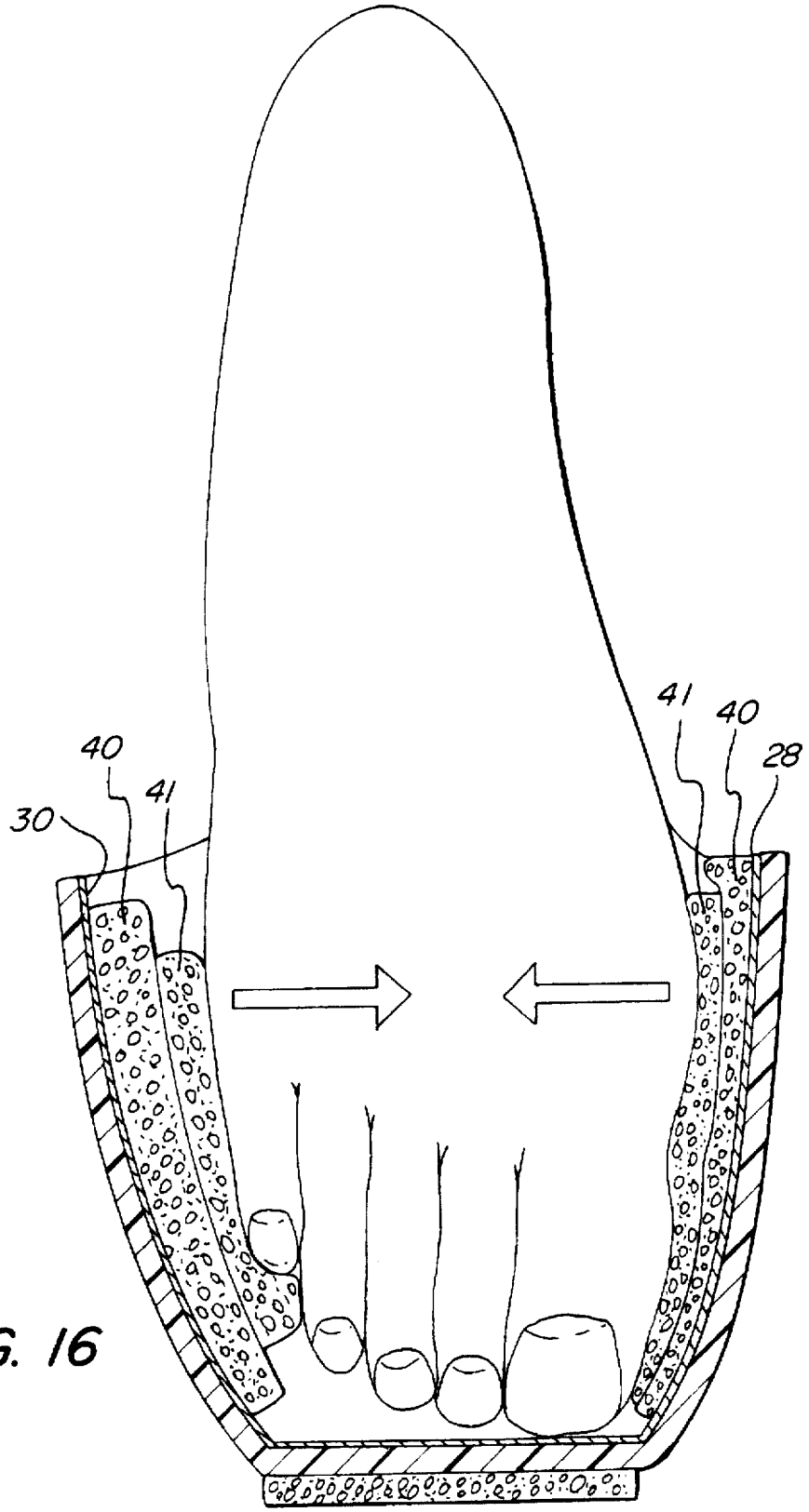
FIG. 16 is a top partial cross-sectional view of the dancer's foot and the dance shoe of FIG. 5.

The dynamic foam pads 40,41 have a fast resilient characteristic such that the foam pads 40,41 are compressed by a dancer's foot when the foot is in the flat standing position, but the foam pads 40,41 expand to snugly hold and support the dancer's foot when it becomes narrower when the dancer stands en pointe. This feature is illustrated in FIGS. 2–5 and 15–16. In FIG. 2, the dancer is standing flat-footed, and the dancer's foot, shown in the shoe 20 in FIGS. 3 and 15, is in a relaxed state and is spread out to a maximum width, for example in landing from a jump. The foam pads 40,41 provide a comfortable fit, and are compressed as schematically illustrated. In FIG. 4, the dancer's foot is in the pointe position, and the dancer's foot, as shown in FIGS. 5 and 16, has compressed to a narrower width. The foam pads 40, 41 expand to provide a comfortable and supporting fit as schematically illustrated.

The foam pads 40, 41 are made from a highly resilient material that possesses the essential dynamic quality even in thicknesses as small as 1/16 of an inch. Preferably, the foam pads 40,41 have a thickness of between about 1/16 inch to about 3/16 inch. In the preferred embodiment it is made from an open-celled urethane foam with a durometer of Shore A 8–24, and having a compression force deflection of 8–25 lbs./in$^2$ (@ 25% ASTM Test No. 3574 and 1667). The foam pads 40,41 have a compression see of less than 2% at 73° F., and a compression set of less than 10% at 158° F. (25% ASTM Test No. 3574 and 1667). It is understood that a different material that provides the essential dynamically supportive function is still within the scope and spirit of the invention.

In the most preferred embodiment the foam pads 40,41 are a 1/16" layer of Poron® foam, durometer approximately 16, which has on one side a soft facing 42. In the most preferred embodiment this facing material 42 wicks perspiration away from the foot. In the most preferred embodiment it is a wicking material sold under the brand names of COOL-MAX® OR ULTRI-LURE®; or a polypropylene material. Such a facing provides a cool and pleasant surface against the foot. Many pointe shoes currently in use have only a coarse muslin lining that can chafe and cause blisters.

The foam pads 40,41 have the great advantage of versatility in that they are removable. This provides the dancer a significant advantage over a pointe shoe with a padded toe box. Such padded toe boxes do not allow for changes in the foot due to temperature, or for the tremendous variety of foot types. The pressure of the foot holds the pads 40,41 in place during use, making glue unnecessary, although adhesive strips 43 may be provided if desired, as shown in FIG. 13. The removable characteristic allows the liner to be used in all types of pointe shoes.

The removable foam pads 40,41 have the further advantage of allowing the dancer to adjust the fit of her shoe as her foot changes due to temperature and intensity of dancing. Many dancers experience dramatic swelling in their feet when they dance long hours in hot weather. Feet can become as much as a size larger in the course of a day, and shrink down again overnight. Removable foam pads 40,41 may be worn in double layers when feet are at their smallest, or removed entirely to make room for swollen feet.

Although pointe shoes should never be fitted with room to grow because an overly large shoe would fail to provide support, the foam pads 40,41 of the present invention allow the young dancer to buy a slightly larger shoe and still obtain excellent support. If her foot grows or swells the foam pads 40,41 can be removed and shoes can still be used a significant economic advantage.

The foam pads contact only the sides (in side cushions 40), and in some instances the top (in box liner 41), of the fore foot— they do not lie under the foot or toes. Dancers are not even aware of their presence, only of the increased comfort of their shoes. This is in marked contrast to the liners of prior art that lie under the toes or in the front of the toe box. Their removable characteristic has the further advantage of allowing the dancer to position the foam pads 40,41 closer or further from the tip of the shoe for maximum comfort. This also allows her to optimize her appearance in that the foam pads 40,41 can be used to fill out certain areas of the shoe to create the desired sleek-fitting look.

Referring to FIGS. 11–14, an additional feature of the invention, namely toe pocket cushion 50, is shown. Toe pocket cushion 50 is an aid to dancers whose second toe is longer than the big toe and third toe. Such dancers typically experience extreme strain on the second toe when dancing in the pointe position. The toe pocket cushion when installed, and as best shown in FIG. 12, provides support for the big and third toes while leaving room for the second toe. This permits the dancer to support herself en pointe without unequal stress on the toes. The toe pocket cushion can be installed as described above in connection with foam pads 40,41. The toe pocket cushion 50 is generally crescent shaped to provide a space 52 between the portions 54 of cushion 50. A crescent shape makes it easier to install the cushion 50 with the portions 54 spaced apart an appropriate distance.

It is noted that in FIG. 12, the thickness of cushion 50 is somewhat exaggerated for clarity, and that in the preferred embodiment the cushion 50 will have a thickness of about 1/16 inch to about 3/16 inch.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. A dance shoe, comprising:

a toe box having an inner surface including a top surface and left and right side surfaces;

a shank joined with and extending rearwardly from said toe box, an upper surface of said shank forming a bottom inner surface of said toe box;

a dynamic foam pad located in at least one of said left and right side surfaces of said toe box and not being located on said bottom inner surface of said toe box, said dynamic foam pad having a low compression set providing a fast resilient characteristic wherein said foam pad is compressed by a dancer's foot when the foot is in the flat standing position and said foam pad expands to support the dancer's foot upon narrowing of the dancer's foot when the dancer is standing en pointe.

2. A dance shoe in accordance with claim 1, wherein there is one such dynamic foam pad located against both said left side and said right side surfaces of said toe box.

3. A dance shoe in accordance with claim 1, wherein said dynamic foam pad comprises a lining covering said top surface and said left and right side surfaces of said toe box.

4. A dance shoe in accordance with claim 1, wherein said dynamic foam pad comprises an open cell polyurethane foam.

5. A dance shoe in accordance with claim 4, wherein said open cell polyurethane foam comprises a material having a compression set of less than 2% at 73° F. and less than 10% at 158° F.

6. A dance shoe in accordance with claim 1, wherein said dynamic foam pad has a thickness of between about 1/16 inch to about 3/16 inch.

7. A dance shoe in accordance with claim 1, wherein said foam pad further comprises a layer of a wicking material.

8. A dance shoe in accordance with claim 1, further comprising a crescent shaped toe pocket cushion installed inside said toe box, said toe pocket cushion providing support for a big toe and a third toe of a dancer with a space for a second toe of the dancer.

9. A dance shoe, comprising:

a toe box having an inner surface including a top surface and left and right side surfaces;

a shank joined with and extending rearwardly from said toe box, an upper surface of said shank forming a bottom inner surface of said toe box;

a dynamic open cell polyurethane foam pad located in at least one of said left and right side surfaces of said toe box and not being located on said bottom inner surface of said toe box, said dynamic foam pad having a low compression set providing a fast resilient characteristic wherein said foam pad is compressed by a dancer's foot when the foot is in the flat standing position and said foam pad expands to support the dancer's foot upon narrowing of the dancer's foot when the dancer is standing en pointe.

10. A dance shoe in accordance with claim 9, wherein there is one such dynamic foam pad located against both said left side and said right side surfaces of said toe box.

11. A dance shoe in accordance with claim 9, wherein said dynamic foam pad comprises a lining covering said top surface and said left and right side surfaces of said toe box.

12. A dance shoe in accordance with claim 11, wherein said dynamic foam pad has a thickness of between about 1/16 inch to about 3/16 inch.

13. A dance shoe in accordance with claim 9, wherein said open cell polyurethane foam comprises a material having a compression set of less than 2% at 73° F. and less than 10% at 158° F.

14. A dance shoe in accordance with claim 9, wherein said foam pad further comprises a layer of a wicking material.

15. A dance shoe in accordance with claim 9, further comprising a crescent shaped toe pocket cushion installed inside said toe box, said toe pocket cushion providing support for a big toe and a third toe of a dancer with a space for a second toe of the dancer.

16. In a dance shoe having a toe box having an inner surface including a top surface and left and right side surfaces and a shank joined with and extending rearwardly from said toe box, an upper surface of said shank forming a bottom inner surface of said toe box, the improvement comprising:

a dynamic foam pad located in at least one of said left and right side surfaces of said toe box and not being located on said bottom inner surface of said toe box, said dynamic foam pad having a low compression set providing a fast resilient characteristic wherein said foam pad is compressed by a dancer's foot when the foot is in the flat standing position and said foam pad expands to support the dancer's foot upon narrowing of the dancer's foot when the dancer is standing en pointe.

17. In a dance shoe in accordance with claim 16, the improvement wherein there is one such dynamic foam pad located against both said left side and said right side surfaces of said toe box.

18. In a dance shoe in accordance with claim 16, the improvement wherein said dynamic foam pad comprises a lining covering said top surface and said left and right side surfaces of said toe box.

19. In a dance shoe in accordance with claim 16, wherein said dynamic foam pad comprises an open cell polyurethane foam.

20. A dance shoe in accordance with claim 16, wherein said open cell polyurethane foam comprises a material having a compression set of less than 2% at 73° F. and less than 10% at 58° F.

21. In a dance shoe in accordance with claim 16, wherein said dynamic foam pad has a thickness of between about 1/16 inch to about 3/16 inch.

22. A dance shoe in accordance with claim 16 wherein said foam pad further comprises a layer of a wicking material.

* * * * *